United States Patent [19]

Hatch, III

[11] Patent Number: 4,784,027

[45] Date of Patent: Nov. 15, 1988

[54] INERTIAL HAMMER WITH SAFETY CONNECTION

[76] Inventor: A. Frost Hatch, III, 475 S. Second St., St. Helens, Oreg. 97051

[21] Appl. No.: 75,580

[22] Filed: Jul. 20, 1987

[51] Int. Cl.[4] ..... B25B 19/00; B21C 1/00

[52] U.S. Cl. ..... 81/463; 29/254; 72/705

[58] Field of Search ..... 81/463, 465, 466; 29/254, 255, 278; 72/705, 421, 457; 16/123, 111 R, 112, 114 R, 114 B, 118, 119, 121, 122, 106, 127

[56] References Cited

U.S. PATENT DOCUMENTS

| | | | |
|---|---|---|---|
| 455,769 | 7/1891 | Smith | 16/123 |
| 2,791,926 | 5/1957 | Guyton . | |
| 2,934,984 | 5/1960 | Woodman . | |
| 3,030,837 | 4/1962 | Chartier . | |
| 3,206,844 | 9/1965 | Bowden | 29/278 |
| 3,483,727 | 12/1969 | Giannetto . | |
| 3,545,250 | 12/1970 | Jones | 72/705 |
| 3,570,289 | 3/1971 | Smyers . | |
| 3,878,709 | 4/1975 | Chartier . | |
| 4,034,594 | 7/1977 | Morgan . | |
| 4,125,927 | 11/1978 | Geary | 29/254 |

OTHER PUBLICATIONS

Kansas Jack Catalog Jan. 12, 1982.

*Primary Examiner*—Frederick R. Schmidt
*Assistant Examiner*—Blynn Shideler
*Attorney, Agent, or Firm*—Kolisch, Hartwell & Dickinson

[57] ABSTRACT

The inertial hammer of the invention includes a spherical mass and a handlebar. The bar runs along a diameter of the spherical mass and extends a predetermined distance from each side of the mass so that an operator may grasp one end of the bar in each hand. The mass and bar comprise what is herein referred to as inertia producing means. A loop or eye is attached to the spherical mass. A first flexible connector is attached between the eye and an object to be repaired. A second flexible connector is attached between the inertia producing means and an anchor. The second flexible connector is of a predetermined length so that when the hammer is operating and the first flexible connector is fully extended, the second flexible connector is in a slack condition. The connectors are attached to the damaged part and anchor by an attachment device. The second flexible connector acts as a safety connection to stop the motion of the mass in the event the first flexible connector breaks free of the object.

6 Claims, 2 Drawing Sheets

INERTIAL HAMMER WITH SAFETY CONNECTION

BACKGROUND OF THE INVENTION

1. Field of the Invention

This invention relates to hand-held inertial hammers. More particularly, this invention concerns devices used to repair damaged or dented vehicle body parts or to pull free gears, wheels or pulleys.

2. Description of the Prior Art

Inertial hammers have generally consisted of a rigid or flexible member on which is attached a sliding mass. One end of the member is attached to the dented area, the opposite end being held by the operator. The sliding mass is brought back quickly along the member until it strikes an object attached to the member near the end being held. The inertial force of the sliding mass is transferred by the member to the dent, thereby pulling the dent out. Such devices negate the need to pound a dent out from its often inaccessible inside surface.

Dent removing tools have been designed so that the operator holds the device in one hand and operates the sliding mass with the other hand. Thus, the size of the device and the sliding mass are limited to what may be held by one hand. Generally such sliding weights have been limited to 6 or 7 pounds. To provide greater forces to straighten severely damaged vehicles, hydraulic pull systems have been devised. However, there is a gap in the art where manual operation is desired, allowing for different pulling directions, but where greater force is required than can be supplied by known handheld devices. There is an additional need in the art for a safety feature to secure the inertial hammer to an anchor in case the primary attachment between the inertial hammer and the object being repaired breaks free.

An object of this invention is to provide an inertial hammer which directs an inertial force in different directions to pull out dents from vehicular body parts or to pull free gears, wheels or pulleys.

Another object of this invention is to provide a hand-held tool capable of producing sufficient force so that dents which were previously irreparable by hand-held tools are now reparable. Thus, it eliminates the need to use hydraulic pull systems to repair some dents which were not previously reparable by hand-held tools.

An additional object of this invention is to provide a safety connection which would operate to stop the motion of the hammer in the event the primary connection between the inertial mass and the dented body or part is broken.

A further object of this invention is to provide an inexpensive and easy-to-use inertial hammer.

SUMMARY OF THE INVENTION

The hammer of the invention comprises a spherical mass and a handlebar. The bar runs along a diameter of the spherical mass and extends a predetermined distance from each side of the mass so that an operator may grasp one end of the bar in each hand. The mass and bar comprise what is herein referred to as inertia producing means. A loop or eye is attached to the spherical mass. A first flexible connector, which may be of varying lengths, is attached between the eye and an object to be repaired. A second flexible connector is attached between the inertia producing means and an anchor. The second flexible connector is of a predetermined length so that when the hammer is operating and the first flexible connector is fully extended, the second flexible connector is in a slack condition. The flexible connectors are attached to the object and anchor by a nut and bolt arrangement, a hook, clip, clamp or similar attachment device. The second flexible connector acts as a safety connection to stop the motion of the mass in the event the first flexible connector breaks free of the object.

DETAILED DESCPRIPTION OF THE PREFERRED EMBODIMENTS

Figure 1:
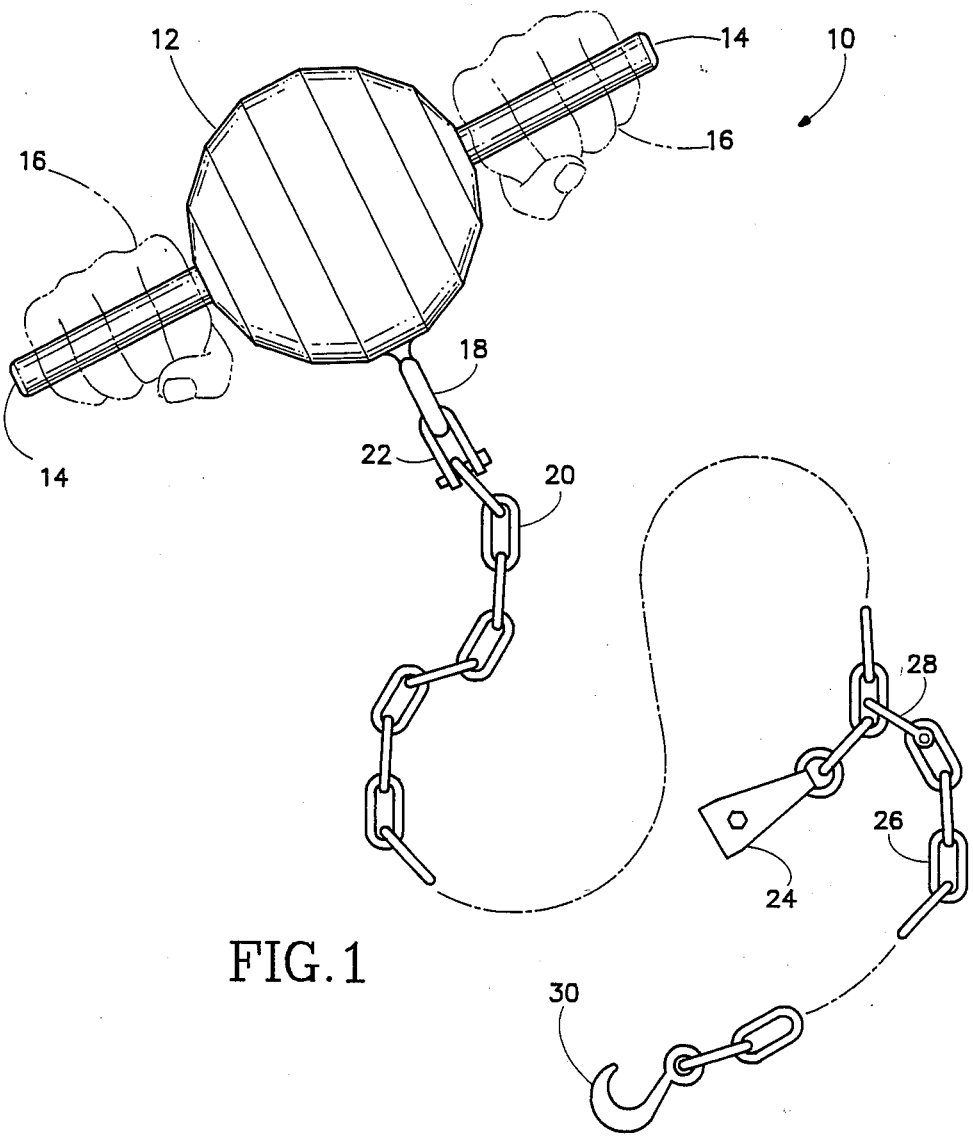
FIG. 1 is a plan view of a first embodiment of an inertial hammer according to the invention.

Referring to FIG. 1, a first embodiment of an inertial hammer of the invention is shown generally at 10. The hammer includes a central mass 12 and a bar 14. Bar 14 extends from each side of central mass 12 a sufficient, predetermined distance to form a handle, a handle means, for gripping by an operator, shown in phantom and identified by reference number 16. Mass 12 and bar 14 comprise what is herein referred to as inertia producing means.

The hammer is designed so that the operator may use both hands 16 to support mass 12, one hand gripping each end of bar 14. In the preferred embodiments bar 14 and mass 12 have a combined weight of about 25 pounds.

Mass 12 and bar 14 may be formed in various ways, which are known to those skilled in the art; for example, by casting or machining. Additionally, mass 12 and bar 14 may be formed separately and then fastened together by welding, screwing or other means.

An eye 18 is attached to central mass 12. Eye 18 may be machined or molded simultaneously with mass 12 and bar 14, or it may be made separately and screwed, welded or attached in some other way to mass 12.

A first flexible connector 20, is provided to impart an inertial force to an object. Connector 20 is attached at one end thereof to eye 18. In the preferred embodiments, first flexible connector 20 is attached to eye 18 by means of clevis 22. Eye 18 and clevis 22 comprise what is herein referred to as first attachment means.

An attachment means or device 24 is attached to the other end of first flexible connector 20. Attachment device 24 may comprise a nut and bolt configuration, hook, clip, clamp or other attachment apparatus. Attachment device 24 comprises what is herein referred to as second attachment means or clipping means.

In the first embodiment, a second flexible connector 26 is attached at one end thereof to first flexible connector 20 by means of clevis 28. Clevis 28 comprises what is herein referred to as third attachment means. Alternately, second connector 26 may be secured to first connector 20 by means of a split chain link.

An attachment device, represented at 30 by a hook, is attached to the other end of second flexible connector 26. Attachment device 30 comprises what is herein referred to as fourth attachment means.

Figure 2:
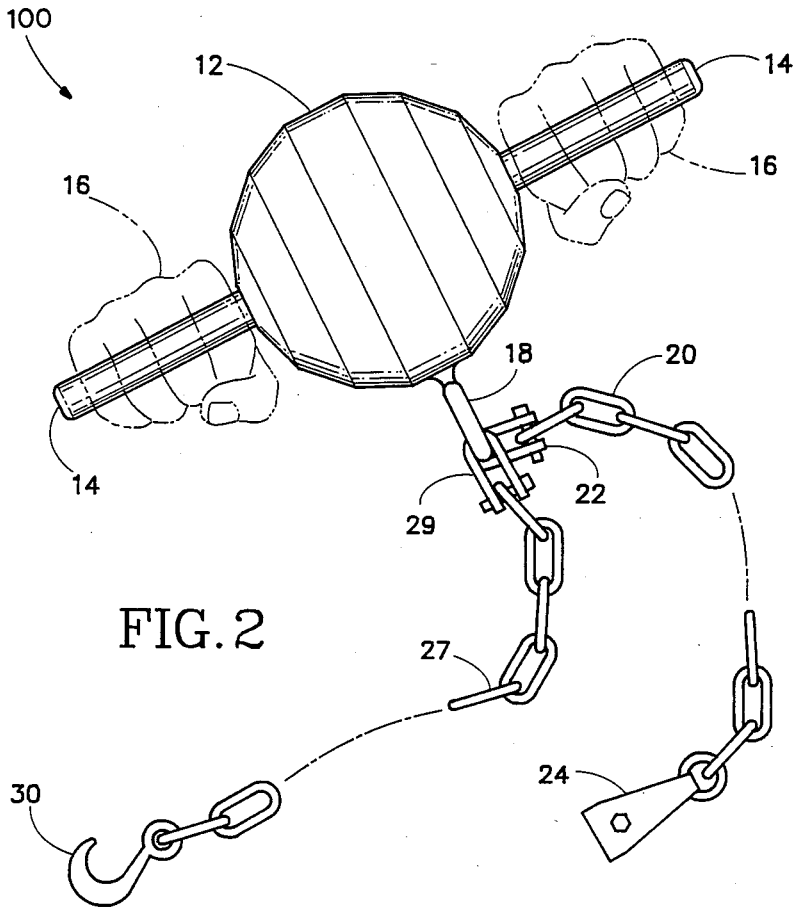
FIG. 2 is a reduced size plan view of a second embodiment of an inertial hammer constructed according to the invention.

Turning now to FIG. 2, a second embodiment of an inertial hammer constructed according to the invention is shown generally at 100. The second embodiment is constructed and operated in basically the same manner as the first embodiment. Those elements common to both the first and second embodiments are identified by like numbers. However, in the second embodiment, a second flexible connector 27 is attached at one end thereof to eye 18 by means of clevis 29. Eye 18 and clevis 29 in this instance comprise what is herein referred to as third attachment means. In the second embodiment, second flexible connector 27 is longer than first flexible connector 20.

In both the first and second embodiments, second flexible connectors 26 and 27, respectively, are operably connected to the inertia producing means. In the first embodiment, second flexible connector 26 is attached to first flexible connector 20 at a predetermined position. In the second embodiment, second flexible connector 27 is attached directly to eye 18.

Figure 3:
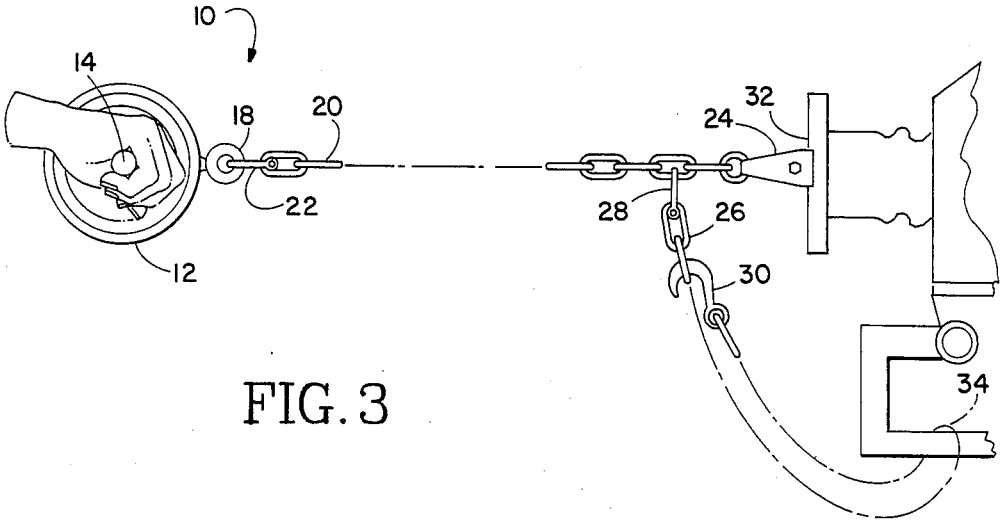
FIG. 3 is an environmental view of the inertial hammer of FIG. 1, showing the second flexible connector in a slack condition.

In FIG. 3, the first embodiment of the inertial hammer of the invention is shown in an environmental setting. First flexible connector 20 is attached at 32 by attachment means 24, which is a clip mechanism, to a damaged portion of the object to be repaired. Second flexible connector 26 is anchored at 34 and is shown in a slack condition.

Figure 4:
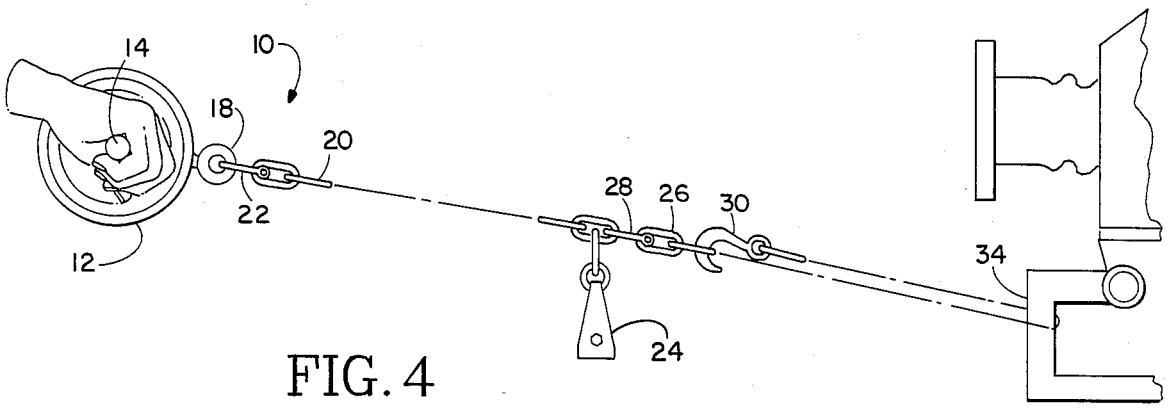
FIG. 4 is an environmental view of the inertial hammer of FIG. 1, showing the second flexible connector engaged.

In FIG. 4, the first embodiment of the invention is shown in an environmental setting with second flexible connector 26 in operation. First flexible connector 20 has become disconnected from the damaged portion of the object being repaired. Second flexible connector 26 is engaged to stop the motion of mass 12. Second flexible connector 26 has been anchored at 34. Operation of inertial hammer 100 is similar to that of hammer 10.

In the drawings both first flexible connector 20 and second flexible connectors 26 and 27 are represented by chains. However, both the first and second flexible connectors could be rope, cable or various other flexible connectors.

Operation

Operation of the inertial hammer of the invention will now be described as the invention relates to automotive body repair. Use of the invention as a gear or wheel puller will be apparent to those skilled in the art.

To operate the inertial hammer of the invention, the hammer must first be attached to an object to be repaired. First flexible connector 20 is fastened to the object by attachment means 24. When attachment means 24 comprises a clip, the jaws of the clip are positioned on opposed sides of the portion of the object being repaired and then tightened, generally by means of a nut and bolt. Additionally, second flexible connector 26 is attached to an anchor. In FIGS. 3 and 4, second flexible connector 26 has been looped around an anchor at 34 and fastened by attachment device 30, inserting a hook of device 30 into a link of the chain comprising second flexible connector 26.

Once attached, the operator grasps bar 14 and sets mass 12 in motion away from the dent or object being repaired. When first flexible connector 20 is fully extended, the inertial forces of moving mass 12 are imparted to the object undergoing repair, thereby pulling out dents or pulling objects free. Second flexible connector 26 stops mass 12 in the event first flexible connector 20 breaks loose during operation.

Inertial hammer 10 has been designed to accommodate connectors of varying lengths. First flexible connector 20 may be easily removed at clevis 22 and exchanged with another connector of a different length. Second flexible connector 26 may be similarly changed. When using connectors of varying lengths care should be taken to insure that when first flexible connector 20 is fully extended, second flexible connector 26 is still slack.

While a preferred embodiment of the invention has been disclosed, it should be understood that certain variations and modifications may be made thereto without departing from the spirit of the invention.

It is claimed and desired to secure by Letters Patent:

1. A inertial hammer for use on an object, comprising:
   - inertia producing means which includes a substantially spherical mass and an elongate bar extending along a diameter of the spherical mass both ends of said bar extending a predetermined distance form the spherical mass forming two diametrically spaced handle means,
   - first attachment means attached to the inertia producing means,
   - a first flexible cable attached at one end thereof to the first attachment means,
   - second attachment means secured to the free end of the first flexible cable for attaching same to the object,
   - third attachment means operably connected to the inertia producing means,
   - a second flexible cable attached at one end thereof to the third attachment means, and
   - fourth attachment means secured to the free end of the second flexible cable for anchoring same to the object, the second cable acting as a safety cable to restrain movement of the inertia producing means in the event of disconnection of the second attachment means from the object.

2. The device of claim 1, wherein the second cable is of a predetermined length such that when the first flexible cable is fully extended, the second flexible cable is still slack.

3. The device of claim 1, wherein the first attachment means includes an eye fixed to the mass and a clevis attached to the eye.

4. An inertial hammer for use on an object, comprising:
   - a substantially spherical mass,
   - an elongate bar running along a diameter of the spherical mass and extending on both ends a predetermined distance from the spherical mass forming two diametrically spaced handle means,
   - first attachment means attached to the spherical mass,
   - a first chain fastened at one end thereof to the first attachment means,
   - clipping means fastened to the free end of the first chain, allowing for the first chain to be clipped to the object,
   - a clevis attached to the first chain,
   - a second chain fastened at one end thereof to the clevis,
   - anchoring means fastened to the free end of the second chain, for anchoring the second chain to the object.

5. The device of claim 4, wherein the first attachment means includes an eye fixed to the mass and a clevis attached to the eye.

6. The device of claim 4, wherein the second chain is of a predetermined length such that when the inertial hammer is operative and the first chain is fully extended, the second chain is still slack.

* * * * *